United States Patent [19]

Greulich

[11] Patent Number: 4,817,234

[45] Date of Patent: Apr. 4, 1989

[54] VACUUM CLEANER WITH SHIELDED ELECTRONIC CONTROL MODULE

[75] Inventor: Gregg A. Greulich, Boyle County, Ky.

[73] Assignee: Whirlpool Corporation, Benton Harbor, Mich.

[21] Appl. No.: 223,562

[22] Filed: Jul. 25, 1988

[51] Int. Cl.[4] ..... A47L 9/28

[52] U.S. Cl. ..... 15/339; 361/118; 361/212

[58] Field of Search ..... 15/339; 361/91, 118, 361/212, 220

[56] References Cited

U.S. PATENT DOCUMENTS

| | | | |
|---|---|---|---|
| 4,404,615 | 9/1983 | Dep | 361/212 |
| 4,426,675 | 1/1984 | Robinson et al. | 361/212 X |
| 4,564,880 | 1/1986 | Christ et al. | 361/212 |
| 4,715,085 | 12/1987 | Johanson | 15/339 |
| 4,715,086 | 12/1987 | Johanson et al. | 15/339 |

*Primary Examiner*—Chris K. Moore

*Attorney, Agent, or Firm*—Mason, Kolehmainen, Rathburn & Wyss

[57] ABSTRACT

A vacuum cleaner includes an operating handle having a compartment for containing a shielded electronic control module for operational control of the vacuum cleaner. The electronic control module includes a touch sensitive outer surface exposed in an opening of the compartment so that a user can effect control of the vacuum cleaner by touching a faceplate or keyboard to actuate touch sensitive components such as switches mounted on a circuit board behind the faceplate. A first shielding peripheral side wall is integrally joined to the faceplate surrounding the circuit board and a second peripheral side wall is formed around the circuit board in a nested, overlapping abutting relationship to the first side wall to establish an elongate electrical creep path between a touch point on the outer surface of the faceplate and a point or surface of a different electrical potential associated with one or more of the electrical components on the circuit board. The elongate electrical creep path is of sufficient length to minimize the possibility of an electrical breakdown due to a high voltage static electric charge. A close fitting tight seal is provided between abutting overlapping surfaces of the nested side walls to minimize or prevent the ingress of environmental contaminants between the side walls, the presence of which contaminants would otherwise reduce the effective length of the electrical creep path.

16 Claims, 2 Drawing Sheets

VACUUM CLEANER WITH SHIELDED ELECTRONIC CONTROL MODULE

BACKGROUND OF THE INVENTION

A. Field of the Invention

The present invention relates generally to vacuum cleaners and, more particularly, to a vacuum cleaner having an electronic control module that is shielded to provide immunity from electrostatic discharges.

B. Description of the Prior Art

Modern-day vacuum cleaners often employ electronic controls in the form of low voltage electronic components mounted on circuit boards. These controls can be damaged or rendered inoperative by inadvertent high voltage electrostatic discharges, such as those accumulated on the body of a user. When the electronic controls of a vacuum cleaner are touched by a user, an inadvertent high voltage static electrical discharge may occur with possible resultant damage to the sensitive electronic components. The vacuum cleaner of the present invention is concerned with the minimization of any such damaging static discharges.

A number of prior art patents have been directed to preventing electrical damage to sensitive electronic components. For example, U.S. Pat. No. 3,648,108 discloses a non-conductive carrier or package for a dual in-line integrated circuit having fourteen electrical leads extending therefrom. The carrier includes a conductive shunt resiliently engaging and, therefore, electrically shorting together the fourteen leads of the integrated circuit, thereby to protect the integrated circuit against possible damage due to static discharge from external sources.

U.S. Pat. No. 3,774,075 similarly is directed to a non-conductive carrier or package for integrated circuits having multiple leads. The carrier includes a conductive shunt for electrically shorting together the conductive leads, thereby reducing the possibility of damage to the integrated circuit as a result of static electricity.

U.S Pat. No. 4,303,960 is directed to a method and structure for protecting a tactile or touch operated keyboard type switch from damage due to a static electrical discharge initiated by the proximity of the finger of a human operator to the switch contacts. A layer of grounded, electrically conductive material is disposed adjacent the switch contacts to intercept any electrostatic discharge from an operator's finger and to conduct static current to ground, thereby bypassing the switch contacts and the associated electronics.

Another U.S. Pat. No. 4,404,615 discloses an "antistatic container" for packaging and shipping electronic circuit boards. The container includes a conductive liner electrically connected to a ground plane to dissipate electrostatic charges and thereby protect the electronics mounted on the circuit boards contained within the container.

U.S. Pat. No. 4,565,288 also discloses a container for integrated circuit boards having a plurality of downwardly depending electrical leads. The container includes conductive inserts formed therein for dissipating static electricity, thereby to minimize possible damage to the components on the circuit boards.

Another U.S. Pat. No. 4,602,311 discloses a method and apparatus for isolating a metallic fastener connected to a plastic housing from the electronic components disposed within the housing. Specifically, an insulating vault with a well portion is formed within the housing; and the fastener is received and retained within the vault and thereby isolated from the sensitive electronic circuitry within the plastic housing.

U.S. Pat. No. 4,633,364 is directed to a so-called static shock eliminator in which a high electrical resistance plate is disposed adjacent a grounded object, such as a metallic doorknob, handle or key cylinder. A surface on the plate is adapted to be contacted by a person at a point spaced from the grounded object, thereby to dissipate static charges.

None of the aforementioned patents discloses or suggests an effective method or apparatus for protecting sensitive electronic components mounted on a circuit board within a control module of a vacuum cleaner from damage or destruction due to high voltage static electrical discharges.

SUMMARY OF THE INVENTION

An object of the present invention is to provide a new and improved vacuum cleaner having a shielded electronic control module.

Another object of the present invention is to provide a new and improved electronic control module for a vacuum cleaner wherein the possibility of damaging electrostatic discharges is minimized.

Another object of the present invention is to provide a new and improved electronic control module for a vacuum cleaner including a touch sensitive faceplate or control keyboard and a pair of nested overlapping shielding walls that establish an electrostatic creep path between the faceplate and electronic components of the module, the creep path having an effective length sufficient to minimize the possibility of damaging sparkover or electrical discharge due to the presence of a high voltage electrostatic charge on or near the faceplate.

Still another object of the invention is to provide a new and improved electronic control module for a vacuum cleaner that includes a sealant between nested overlapping side walls for minimizing the entry of environmental contaminants that otherwise could reduce the effective length of an established electrostatic creep path formed therealong.

Briefly, a new and improved vacuum cleaner in accordance with the present invention includes an electronic control module having a touch sensitive keyboard or faceplate for operating electrical components mounted on a circuit board for controlling the operation of the vacuum cleaner. The electronic control module has a shielding enclosure and is mounted in a compartment of the vacuum cleaner with the faceplate externally exposed for touch control by a person using the vacuum cleaner.

In order to prevent a damaging electrical sparkover or electrostatic discharge from reaching the components mounted on the circuit board, the circuit board is encapsulated within the shielding enclosure which is formed by the faceplate and an integral first side wall surrounding the periphery of the circuit board. A second side wall is provided in nested overlapping relation with the first wall; and the overlapping segments of the walls establish an electrical creep path extending between the touch sensitive outer surface of the faceplate and the circuit board. The creep path has an effective length sufficient to minimize the possibility of an electrical breakdown along the creep path due to static electrical charges.

The overlapping portions of the side walls include tight fitting surfaces for minimizing the ingress of environmental contaminants between these surfaces, thereby maintaining the effective length of the creep path.

BRIEF DESCRIPTION OF THE DRAWING

The above and other objects, advantages and novel features of the present invention will become apparent from the following detailed description of a preferred embodiment of the present invention illustrated in the accompanying drawing wherein.

DETAILED DESCRIPTION OF THE PREFERRED EMBODIMENT

Figures 1, 2, 3:
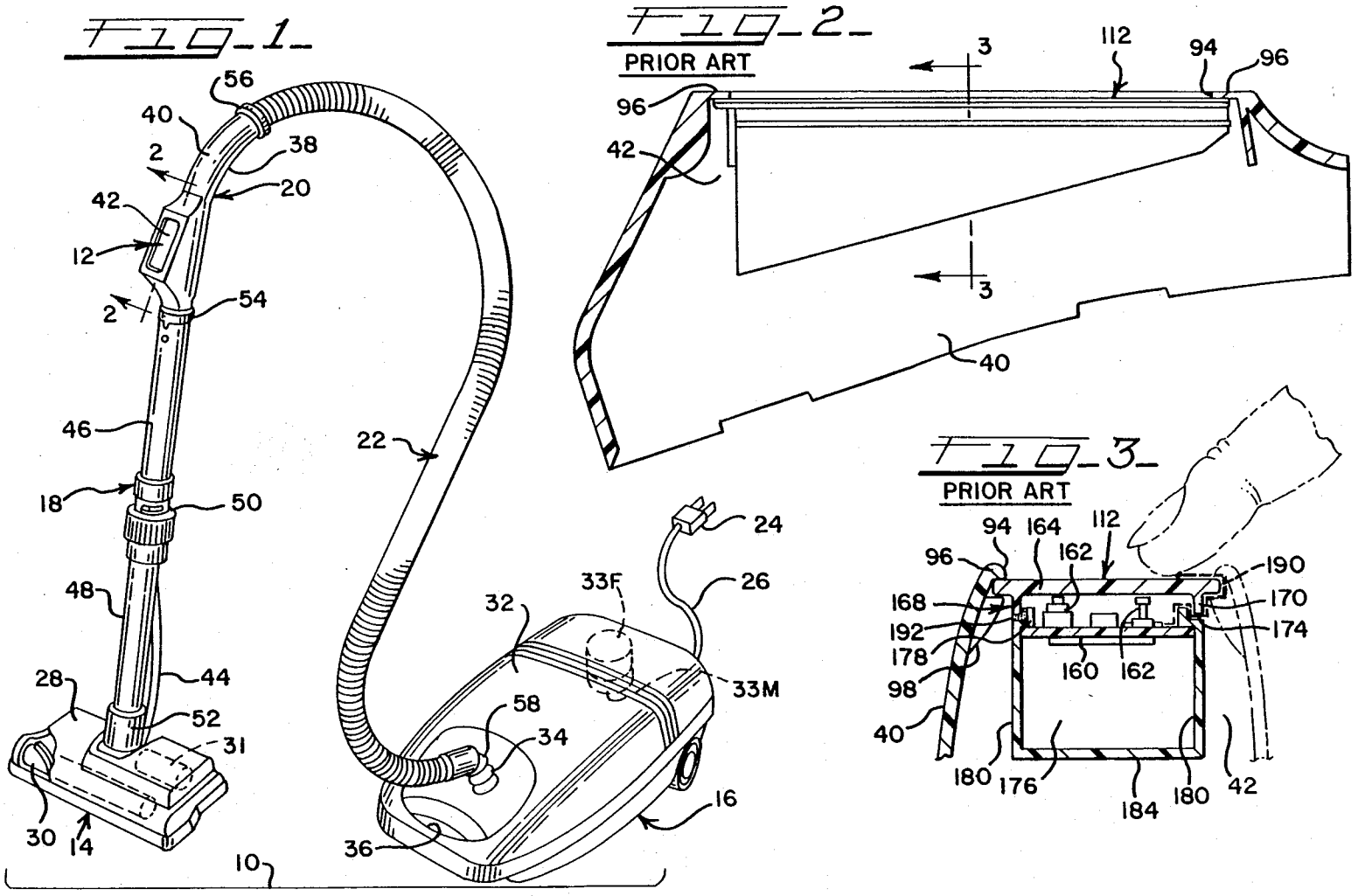
FIG. 2 PRIOR ART
FIG. 3 PRIOR ART
FIG. 1 depicts a vacuum cleaner including a shielded electronic control module constructed in accordance with the principles of the present invention.
FIG. 2 is an enlarged, cross-sectional view of a portion of a wand handle of a PRIOR ART vacuum cleaner depicting the mounting therein of a conventional PRIOR ART electronic control module.
FIG. 3 is an enlarged, cross-sectional view of the PRIOR ART electronic control module of FIG. 2 generally taken along line 3—3 of FIG. 2.

Referring to the drawing and initially to FIG. 1, there is illustrated a new and improved canister vacuum cleaner 10 having a new and improved shielded electronic control module 12 constructed in accordance with the principles of the present invention. While specifically depicted for illustrative purposes in connection with the canister vacuum cleaner 10, the principles of the present invention are equally applicable to electronic control modules used in connection with other vacuum cleaners, such as upright vacuum cleaners. The vacuum cleaner 10 includes a surface or floor cleaning unit 14 and a remotely disposed canister 16 mechanically and pneumatically interconnected by a wand 18, a wand handle 20 and a flexible hose assembly 22. The vacuum cleaner 10 is powered by conventional, 110–120 volt alternating current power through an electrical plug 24 mechanically and electrically secured to a conventional, retractable, electrical power cord 26.

The floor cleaning unit 14 includes a housing 28 in which is disposed a rotatable brush 30 and an electrical brush motor 31 for rotating the brush through a conventional belt drive assembly (not illustrated). The canister 16 includes a housing 32 within which is disposed a conventional dirt collecting bag (not illustrated) and a suction or vacuum fan 33F powered by a conventional, electrical motor 33M. The canister 14 also includes a suction inlet 34 connected to the wand handle 20 through the flexible hose assembly 22. An integrally formed, canister handle 36 is provided for enabling the canister 16 to be carried from place to place by an operator or user of the vacuum cleaner 10.

Suction created by the motor driven fan 33F in the canister 16 is delivered to the remotely located floor cleaning unit 14 through the wand 18, wand handle 20 and the flexible hose assembly 22. The wand handle 20 includes a hollow body formed out of rigid plastic material. The body may be formed in two separate parts, a bottom half 38 and a top half 40 joined together along longitudinally extending seams on opposite sides. The body is generally tubular in shape and includes an elongate, interiorly disposed tubular bore for pneumatically interconnecting the fan in the canister 16 with the floor cleaning unit 14 through the wand 18 and the flexible hose assembly 22. Operation of the vacuum cleaner 10 is controlled by the electronic control module 12 mounted in a housing or compartment 42 comprising an integrally molded section in the top half 40 the wand handle 20. The wand 18 includes an externally disposed power cord 44 that electrically interconnects the electronic control module 12 in the wand handle compartment 42 with the motor 31 in the floor cleaning unit 14.

The flexible hose assembly 22 includes an internal electrical power cord detachably connected to the canister 16 at the downstream end of the hose and detachably connected to the wand handle 20 at the upstream end of the flexible hose. The wand handle 20 is provided with an internal electrical power cord and with a detachable connector at the downstream end for connection to the power cord of the flexible hose assembly 22 and a detachable connector at the upstream end for connection to the external power cord 44 of the wand 18. The internal power cord of the wand handle 20 is also detachably connected to the electronic control module 12 mounted in the control compartment 42 in the top section 40 of the wand handle body so that control of the floor cleaning unit 14 and the canister 16 can be effected from the electronic control module 12 in the wand handle 20.

The wand 18 includes an upper wand section 46 and a lower wand section 48 that may be disconnected from each other or from the floor cleaning unit 14 or from the wand handle 20. The upper wand section 46 is coupled to the lower wand section 48 by a coupling 50 which allows for a quick disconnection of the upper and lower sections. The lower wand section 48 is connected to the floor cleaning unit 14 with a quick disconnect coupling 52. The upper wand section 46 is connected to a stub tube (not illustrated) securely fixed in the upstream end of the tubular bore of the wand handle 20; and a quick disconnect coupling 54 is provided between the upper wand section 46 and the stub tube of the wand handle 20. A disconnect coupling 56 is also provided a downstream end of the tubular bore in the wand handle 20 to permit the wand handle to be disconnected from the flexible hose assembly 22. The canister end of the flexible hose assembly 22 is coupled with the suction inlet 34 of the canister 16 with a disconnect coupling 58. Except for the electronic control module 12, discussed in detail hereinafter, the above features of the vacuum cleaner 10 are conventional and well known in the prior art.

Referring now to FIGS. 1 and 4–6, the electronic control module 12 of the present invention includes a circuit board 60 of generally rectangular shape having an outer face with one or more touch sensitive switches 62 and other sensitive electronic components, such as a microprocessor, mounted thereon. The switches 62 are provided with touch sensitive operators extending outwardly on the circuit board 60 in close proximity with the back side of a touch operated keyboard or faceplate 64. The faceplate 64 is typically formed of non-conductive plastic material which is impervious and flexible so that a user's finger touching the external surface of the faceplate at a particular spot is effective to activate a touch sensitive switch 62 directly beneath the spot on the circuit board 60.

Figures 4, 5, 6, 7:
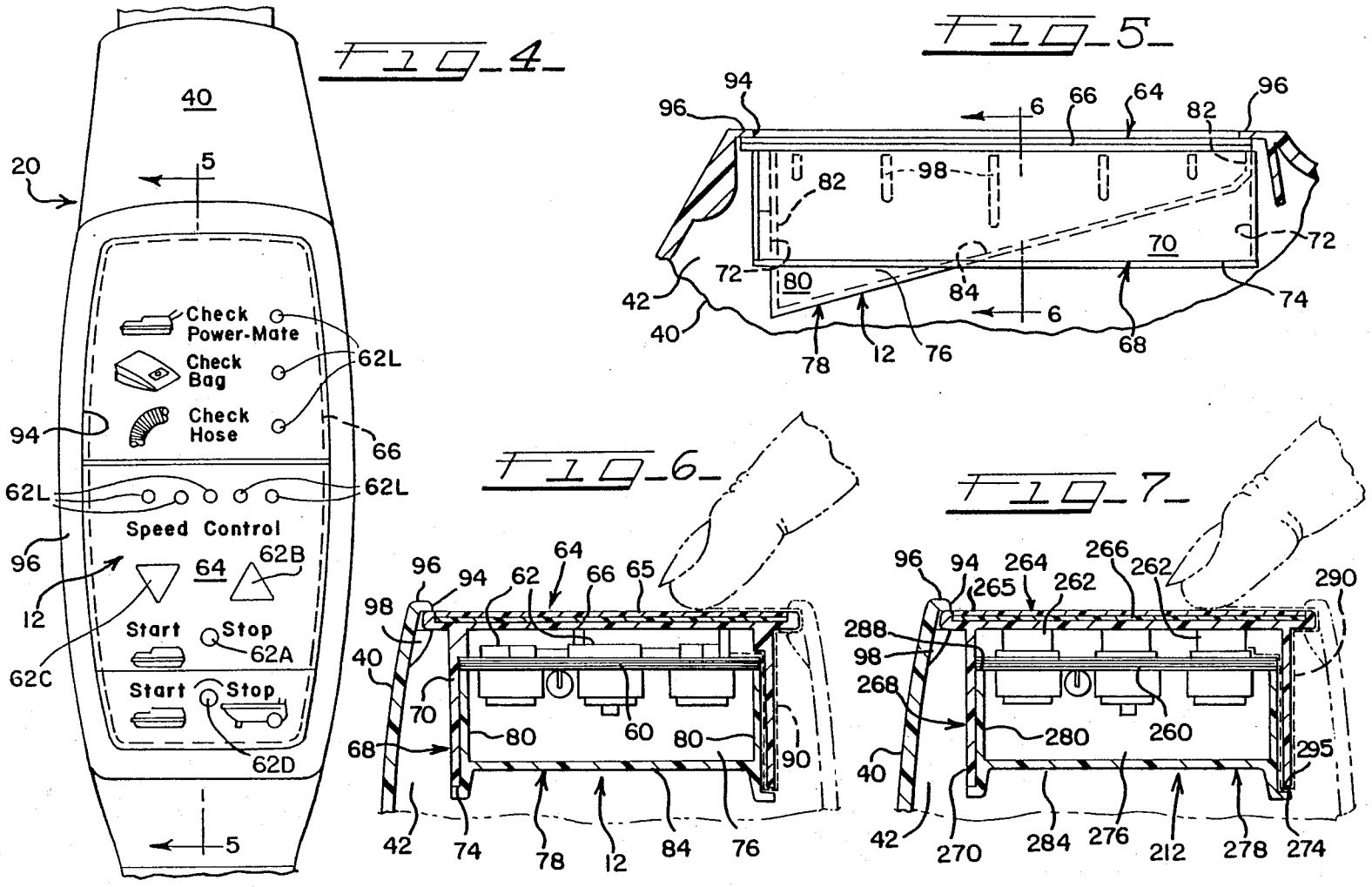
FIG. 4 is an enlarged, plan view of a portion of the vacuum cleaner wand handle of the vacuum cleaner of FIG. 1 having a shielded electronic control module therein constructed in accordance with the principles of the present invention.
FIG. 5 is an enlarged, longitudinal cross-sectional view generally taken along line 5—5 of FIG. 4.
FIG. 6 is an enlarged, transverse cross-sectional view generally taken along line 6—6 of FIG. 5.
FIG. 7 is an enlarged, transverse cross-sectional view, similar to that of FIG. 6, of an alternative embodiment of a shielded electronic control module constructed in accordance with the principles of the present invention.

As shown in FIGS. 4 and 6, a control placard 66 formed of a thin sheet of suitable material such as polyester film is adhesively secured to an outer surface of the faceplate 64 and is covered with an adhesive-backed overlay 65 such as polyester film of clear plastic sheet material to complete the impervious touch sensitive surface of the faceplate 64. The placard 66 includes printed and diagnostic indicia thereon visible through the clear overlay 65 to identify particular functions, such as a Start-Stop switch 62A for energizing and deenergizing the motor 31 of the floor cleaning unit 14, a pair of Up-Down speed control switches 62B and 62C for the suction fan motor 33M and a Start-Stop switch 62D for energizing and deenergizing both the motor 31 and the suction fan motor 33M. In addition, protruding into the placard 66 are several small annunciators or trouble lights 62L mounted on the circuit board 60 for advising the operator to "Check PowerMate" (floor cleaning unit 14), "Check Bag" (collection bag in canister 16), or "Check Hose" (hose assembly 18) and for indicating the speed of the suction fan motor 33M as selected by the switches 62B and 62C.

In accordance with an important feature of the present invention, a continuous peripheral side wall 68 (FIGS. 5 and 6) surrounding the circuit board 60 is integrally joined to the faceplate 64 and is spaced a short distance inwardly of the outer peripheral edge of the faceplate 64. The peripheral side wall 68 includes a pair of elongate, relatively flat, downwardly extending sides 70 joined at their ends to a pair of transversely disposed, laterally extending end walls 72. The walls 70 and 72 extend below the circuit board 60 and include a continuous peripheral edge 74 spaced from and generally parallel of the back side of the integral faceplate 64 and disposed below the circuit board 60.

The back side or underside of the circuit board 60 is mounted in a control module housing 76 preferably formed of non-conductive, molded plastic material and including a continuous peripheral side wall 78 in nested overlapping relation with the outer peripheral side wall 68. The inner peripheral side wall 78 is formed by a pair of longitudinally extending opposite sides 80 nested in and abutting against adjacent inner surfaces of respective overlapping sides 70 of the outer peripheral side wall 68. The sides 80 are integrally interconnected at opposite ends to a pair of transversely disposed, laterally extending end walls 82 nested in and abutting against adjacent inner surfaces of respective end walls 72 of the outer peripheral side wall 68. The housing 76 also includes an integral bottom wall 84 joining the sides 80 and the end walls 82 around the periphery of the continuous side wall 78 to form a sealed enclosure for the circuit board 60.

Referring now in particular to FIG. 6, when an operator's finger touches or is in close proximity to the outer control surface of the faceplate 64, an accumulated static charge, often of relatively high potential, may be present and, potentially, could initiate a static electrical discharge or sparkover between the operator's hand or finger or a touch point on the outer surface of the faceplate 64 and a point or surface at a different electrical potential associated with any of the various electrical components mounted on the circuit board 60. Such a high voltage static electrical discharge or sparkover could severely damage one or more of the electrical components in the electronic control module 12. To reduce the possibility of any such occurrence, however, the nested, overlapping relationship between the sidewalls 68 and 78 establishes a relatively long electrical creep path 90 (indicated by a series of dashes) of a sufficient effective length to minimize the possibility of the occurrence of any such a sparkover or discharge.

The electrostatic creep path 90 extends from a touch point on the outer surface of the faceplate 64 to the nearest outer edge thereof and follows around the extended outer edge portion and along the outer surface of the integral, outer peripheral side wall 68 to the peripheral inner edge 74. The path continues around the inner edge 74 toward the circuit board 60 between the abutting overlapping nested peripheral side walls 68 and 78 until reaching an inner peripheral edge 88 of the side wall 78 on the housing 76. The creep path 90 extends from the edge 88 along the upper surface of the circuit board 60 to terminate at a point or surface of a different electrical potential associated with one or more of the electronic components mounted on the circuit board 60.

The advantages of the present invention are apparent by reference to an illustrative depiction of a prior art control module 112 (FIGS. 2 and 3). The control module 112 is characterized by an electrical creep path 190 having a relatively short effective creep path length between a finger touch point on an outer surface of a faceplate 164 and a point or surface of a different electrical potential associated with one or more of the electrical components 162 mounted on a circuit board 160 behind the faceplate 164. The relatively short effective length of the creep path 190 is due to the relatively short amount of overlapping between the nested peripheral walls 168 and 178. Because the total effective length of the creep path 190 is substantially less than that of the creep path 90 (FIG. 6), an electrostatic discharge or sparkover may occur along the creep path 190 when a high potential difference is established between a finger touch point on the outer surface of the faceplate 164 and the above-mentioned point or surface of a different electrical potential associated with one or more of the components 162 on the circuit board 160. Furthermore, the relatively insignificant overlapping between the walls 168 and 178 results in a poor surface for supporting a sealing compound 192 intended to prevent the ingress of environmental contaminants to the interior of the control module 112. Such environmental contaminants could result in a reduction of the effective length of the creep path 190, resulting in an electrical discharge or sparkover at an even lower potential difference.

In accordance with a further important feature of the present invention, in order to reduce the possibility of environmental contaminants entering or penetrating between the nested surfaces of the walls 68 and 78 (FIG. 6) and thereby reducing the effective length of the creep path 90, the abutting surfaces of the walls 68 and 78 provide a close fitting line to line seal when the housing 76 is assembled that is effective to seal tightly against the entry of outside contaminants.

In accordance with a further important feature of the present invention, an alternative embodiment of a shielded electronic control module 212 constructed in accordance with the principles of the present invention for use in the vacuum cleaner 10 is depicted in FIG. 7.

Components of the module 212 that correspond to similar parts of the module 12 are given the same reference numerals with an added hundredths digit of "2". Only the major differences between the modules 12 and 212 are discussed herein in detail. The module 212 establishes an electrical creep path 290 having an effective length substantially the same as the effective length of the creep path 90 in the module 12. At an inner peripheral edge 274 of an outer peripheral side wall 268 of the module 212, the creep path 290 extends between the peripheral edge 274 and a facing peripheral surface portion 295 of a bottom wall 284. The bottom wall 284 is formed to extend laterally outwardly from an integrally formed inner peripheral side wall 278. The creep path 290 continues toward an inner edge 288 of the side wall 278 to reach the upper surface of the circuit board 260. This particular configuration of the control module 212 provides relatively smooth outer, uninterrupted downwardly extending surfaces for the module 212 as a whole, provides an even longer creep path 290 (compared to the length of the creep path 90) and may facilitate insertion and assembly of the module 212 in the compartment 42 of the wand handle 20. While, preferably., the facing surfaces of the nested walls 68 and 78 (FIG. 6) overlap by an amount greater.than fifty percent of the length or downward extension of the inner wall 78, the facing surfaces 268 and 278 overlap by an amount substantially equal to the length or downward extension of the inner wall 278.

The top half 40 of the wand handle 20 is formed with an enlarged generally rectangular opening 94 (FIGS. 4–7) for externally exposing the touch sensitive control surface of respective control modules 12 and 212 for use by an operator of the vacuum cleaner 10. The opening 94 is dimensioned to be slightly smaller in longitudinal and transverse dimensions than the corresponding dimensions of the faceplates 64 and 264, respectively, of the modules 12 and 212. This arrangement provides a small peripherally extending retaining lip 96 for engaging the outer peripheral surface of the faceplates 64 and 264 for retaining the modules 12 and 212 in the handle 20. The outwardly extending peripheral edges of the faceplates 64 and 264 are retained between the lip 96 and a plurality of longitudinally spaced apart cam ribs 98 integrally formed on the inside surface of the top half 40 of the wand handle 20. The cam ribs 98 extend generally normal to the continuous peripheral rib 96 and permit the control modules 12 and 212 to be readily snapped into and held in place.

Obviously, many modifications and variations of the present invention are possible in light of the above teachings. Thus, it is to be understood that, within the scope of the appended claims, the invention may be practiced otherwise than as specifically described hereinabove.

What is claimed and is desired to be secured by Letters Patent is:

1. A vacuum cleaner comprising a handle including a control housing and an electronic control module in said housing including a circuit board having electronic components mounted thereon, said control module further including a faceplate having a touch sensitive outer surface outwardly of said circuit board and an inner surface and means for establishing an elongate electrical creep path for static electric charges between said outer surface of said faceplate and said circuit board, said creep path having an effective length sufficient to minimize the possibility of an electrical breakdown between said outer surface and said circuit board due to said static electric charges, said establishing means including a first peripheral wall extending around and below said circuit board integral with said faceplate and including an outside face below said circuit board defining at least a portion of said creep path and a second peripheral wall extending below said circuit board in nested overlapping relation with said first wall and defining a portion of said creep path, said creep path extending over at least fifty percent of the extension of said second wall downwardly from said circuit board.

2. A vacuum cleaner as recited in claim 1 wherein said nested overlapping portions of said first and second walls include close fitting surfaces establishing a tight seal for minimizing the ingress of environmental contaminants between said overlapping portions.

3. A vacuum cleaner as recited in claim 1 wherein said control module further comprises a bottom wall integral with said second wall and spaced on an opposite side of said circuit board from said faceplate.

4. A vacuum cleaner as recited in claim 3 wherein said first wall includes a peripheral edge spaced below and away from said faceplate and said bottom wall includes a peripheral surface portion disposed adjacent to and facing said edge.

5. A vacuum cleaner as recited in claim 4 wherein said control module further comprises hermetic sealing means between said peripheral edge of said first wall and said peripheral surface portion of said back wall.

6. A vacuum cleaner as recited in claim 1 wherein said first wall has an inside surface around said circuit board normal to said inner surface of said faceplate and said, second wall has an outer surface in closely abutting overlapping relation to said inside surface forming a portion of said creep path.

7. A vacuum cleaner as recited in claim 6 wherein said first wall has a peripheral edge between said outside face and said inside face spaced apart and facing away from said faceplate.

8. An electronic control module for a vacuum cleaner comprising a circuit board having touch sensitive electronic components mounted thereon, a first shield member for said circuit board including a faceplate spaced outwardly of said circuit board and having a touch sensitive outer surface for operating said components on said circuit board, said shield member further including a first peripheral wall around and extending below said circuit board integral with said faceplate and having an outside surface establishing a portion of an elongate electrical creep path for static electric charges between said outer surface of said faceplate and said circuit board, said outside surface extending downwardly away from said faceplate and said circuit board for providing a creep path having sufficient length to minimize the possibility of an electrical breakdown along said creep path due to the presence of a high voltage static electric charge at said outer surface of said faceplate and a second shield member for enclosing said circuit board on a back side thereof including a second peripheral wall extending around and below said circuit board in nested overlapping relation with said first peripheral wall and defining a second portion of said creep path.

9. An electronic control module for a vacuum cleaner as recited in claim 8 wherein said second peripheral wall includes an outer surface abutting an inside surface of said first peripheral wall for establishing said second portion of said creep path between said control surface of said faceplate and said circuit board.

10. An electronic control module for a vacuum cleaner as recited in claim 9 wherein said nested overlapping first and second peripheral walls include close fitting surfaces establishing a tight seal for minimizing the ingress of environmental contaminants between said abutting surfaces of said first and second peripheral walls, thereby to minimize the possibility of a reduction in the effective length of said creep path due to said environmental contaminants.

11. An electronic control module for a vacuum cleaner as recited in claim 8 wherein said first peripheral wall includes a peripheral edge facing oppositely away from said faceplate and said second shield member includes a back wall spaced from said back side of said circuit board abutting said peripheral edge of said first shield member.

12. A vacuum cleaner comprising a wand handle having a control compartment therein and an electronic control module for said vacuum cleaner mounted in said compartment including a circuit board and a touch sensitive, impervious faceplate for operating electrical components on said circuit board by the touching of an external surface of said faceplate, said control module including a first side wall integrally joining said faceplate and extending around the periphery of and below said circuit board for establishing an elongate electrical creep path for static electric charges extending between said external surface of said faceplate and said circuit board and having an effective length sufficient to minimize the possibility of an electrical breakdown between said external surface of said faceplate and said circuit board when said external surface is touched, said control module including a second side wall in nested overlapping relation to said first wall and having an outer surface abutting said first wall below said circuit board and establishing a portion of said creep path extending between said first wall and said circuit board.

13. A vacuum cleaner as recited in claim 12 wherein said control module includes a back wall for shielding a back side of said circuit board integrally joining said second wall and spaced apart from said faceplate to complete a shielding enclosure around said circuit board.

14. A vacuum cleaner as recited in claim 13 wherein adjacent portions of said first and second side walls are configured to minimize the possibility of the ingress of environmental contaminants between said overlapping first and second side walls.

15. A vacuum cleaner as recited in claim 13 wherein said control compartment includes an opening for said faceplate of said control module and means for securing said control module in said compartment with said faceplate positioned in said opening.

16. A vacuum cleaner as recited in claim 13 wherein said first side wall includes a peripheral edge facing away from said faceplate and said back wall includes a peripheral face extended laterally outwardly of said second wall and abutting said peripheral edge and forming a portion of said creep path outside of said enclosure.

* * * * *